US005903090A

United States Patent [19]

Haag

[11] Patent Number: 5,903,090

[45] Date of Patent: May 11, 1999

[54] AUTOMOTIVE DISCHARGE LAMP WITH FLUIDLY COMMUNICABLE DISCHARGE AND RESERVOIR VOLUMES

[75] Inventor: Ronald Helmut Haag, Clarkston, Mich.

[73] Assignee: Guide Corporation, Anderson, Id.

[21] Appl. No.: 08/770,467

[22] Filed: Dec. 20, 1996

[51] Int. Cl.[6] ..... H01J 5/16

[52] U.S. Cl. ..... 313/113; 313/114; 313/493; 313/634; 362/341

[58] Field of Search ..... 313/113, 114, 313/317, 484, 493, 513, 514, 612, 634, 573, 581, 582; 220/2.1 R; 362/310, 341

[56] References Cited

U.S. PATENT DOCUMENTS 5,608,288 3/1997 Haag ..... 313/612
5,645,337 7/1997 Gleckman ..... 313/113

*Primary Examiner*—Jay M. Patidar
*Attorney, Agent, or Firm*—Ice Miller Donadio & Ryan; Jay G. Taylor

[57] ABSTRACT

A gas discharge lamp has an elongated discharge path in fluid communication with a gas reservoir bounded by reflective sidewalls. The reflective sidewalls provide light directionality as well as major boundaries for a substantial volume of discharge gas while the discharge path provides a tightly focused light source. The substantial volume of discharge gas provided by the reservoir significantly increases lamp life.

23 Claims, 2 Drawing Sheets

AUTOMOTIVE DISCHARGE LAMP WITH FLUIDLY COMMUNICABLE DISCHARGE AND RESERVOIR VOLUMES

TECHNICAL FIELD

The present invention is related to the field of cold cathode discharge lighting, and more particularly to such lighting particularly adapted and suitable for automotive signal lighting.

BACKGROUND OF THE INVENTION

The basic principles and implementations of cold cathode discharge lamps (commonly and hereafter referred to as neon lights) are relatively well known. However, several technical challenges have prevented the widespread use of neon lights for rear lighting and signaling applications in automotive applications.

When designing a gas discharge lighting system particularly for automotive use, there are three very important issues to consider. One is the life expectancy of the lamp, the second is the lamps efficiency, and finally the optical performance must be considered.

The life expectancy of a gas discharge lamp is defined by three main factors, the gas mass present which obviously is affected by the chosen fill pressure and volume, the operating current, and the surface area of the electrodes. It is well known within the industry that aging process of a neon lamp occurs when molecules of the gas are absorbed within the electrodes. The rate of absorption increases rapidly as current increases, which then causes the electrode to "sputter" onto itself and the glass walls of the discharge tube. The deposited material will then trap more gas molecules. Once this process has started, it will likely continue and accelerate until there will be insufficient gas pressure to maintain a discharge and the lamp will eventually fail. This process is the major factor in determining the lamps life and is commonly called gas clean-up.

In the areas of lamp efficiency, it is very important to consider the voltage drop of the discharge itself. This is dependent on two very important parameters, the cross sectional area of the discharge path and the gas pressure.

To generate a light output, electrical energy is transferred to a volume of encapsulated gas, changing the energy state of the gas molecules. As the gas molecules go to a lower energy state, light is emitted. If a discharge path is constrained within a smaller cross sectional area, a higher portion of the energy used in exciting the gas will be released back as light relative to a relativity unconstrained discharge path. However, the constriction raises the resistance of the discharge, which in turn increases the voltage drop, which must be considered when designing the lamp. In addition, reducing the cross sectional area also lessens the gas volume which will then affect the lamp life.

The other key parameter when considering lamp efficiency is gas pressure. In general, lowering the gas pressure increases the efficiency. In a gas at a lower pressure there are fewer molecules per cubic cm than in a gas at higher pressure. Therefore, in the low pressure gas, free electrons have a longer distance in which to gain speed before they hit a neutral molecule. The consequence of this is greater molecule collisions which in turn generate more light. There is a point however when the pressure is too low and the efficiency again falls due to a lack of charge carriers within the discharge tube. It is also important to note, that when very small cross sectional diameter tubes are used to take advantage of the light gains as mentioned above, the small gas volumes available in a low pressure lamp will result in a relatively short lamp life.

The final area to consider when designing a lamp for automotive use is the optical performance of the entire lamp package. A neon tube emits light evenly around its circumference As with any light source, in order to achieve the highest efficiency, the light must be collected and directed in the appropriate direction for each particular application. In addition particular applications may require certain colors or wavelengths. Commonly, this has been achieved by filtering light through certain colored lenses.

U.S. Pat. No. 5,608,288 (hereinafter Haag), also assigned to the assignee of the present invention, provides a neon lamp suitable for automotive application which improves lighting efficiency while providing a design which improves operational life. Haag provides an automotive neon lamp having a first semicircular reflector surface joined to a semi-parabolic surface. Additionally, the neon lamp of Haag has a volumetric concentrator which aids in maintaining the position of the electron discharge path of the neon lamp while at the same time allowing for a greater volume of neon, thereby increasing lamp life while retaining better properties of focusability.

SUMMARY OF THE INVENTION

The present invention provides an improved discharge lamp assembly having a constrained path for the gas that is excited to a discharge state. Additionally, the present invention has a reservoir separated from the discharge path which increases the volume of the gas within the lamp assembly thereby vastly increasing the life.

Additional advantages obtained by implementation of the present invention are design flexibility with respect to shapes and geometries obtainable.

The lamp assembly of the present invention has two spaced apart electrodes. Between the electrodes is an elongated focused path. Adjacent to the focused path are two semi-parabolic reflector surfaces forming a reservoir therebetween. The reservoir, through an orifice, fluidly communicates with the focused path.

The above and other advantages of the present invention will be made more apparent to those skilled in the art as the present invention is explained in greater detail in the following detailed description and accompanying drawings.

DESCRIPTION OF THE PREFERRED EMBODIMENT

Figure 1:
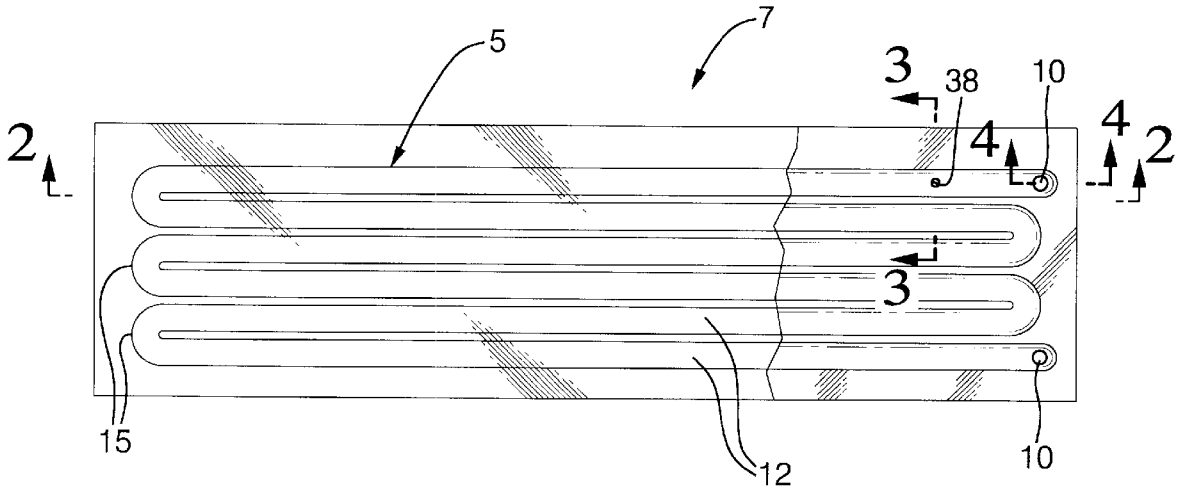
FIG. 1 is a front elevational view, partially sectioned, of a preferred embodiment neon-type automotive signal lamp according to the present invention.

Referring to FIGS. 1 through 6, certain preferred embodiments of the present invention are illustrated. The embodiments shown are part of an automotive signal lamp such as a tail light assembly generally designated by the reference numeral 7. A continuous light tube 5 is fashioned in serpentine pattern between a pair of electrodes 10. Each electrode is associated with one end of the serpentine light tube and in the present exemplary embodiment are both located at one end of the light assembly 7. The serpentine shape generally includes a plurality of straight runs 12 and at least one end return 15 therebetween. Light assembly 7 may be adapted for incorporation into a tail lamp unit and hence placed behind a plastic light housing 71.

Each electrode 10 is fabricated from a metal or a metal alloy that substantially matches the coefficient of expansion of the type of glass being used in the fabrication of the light tube 5. For example, a glass of the boroscilicate variety may successfully be matched with electrodes fabricated from Kovar or tungsten. Boroscilicate is the variety of glass assumed to be used in the exemplary embodiment and hereafter, unless noted otherwise, the mention of glass is to be understood to mean boroscilicate glass. A typical electrode pair employing metals of this variety would be characterized by voltage drops substantially within the range of 140 to 180 volts. The electrodes 10 will be connected to a ballast (not shown) capable of power delivery in accordance with the specific voltage-current characteristics at the light output desired from the light assembly. Generally, a factor in determining the size of the electrodes is the current level which is to be driven thereby. In the present embodiment, the nominal current delivery is between 15 to 25 mA. The specific application, however, will dictate the current requirements. For the particular embodiment shown in the various figures, the electrodes may have an outer diameter of substantially 5.0 mm and an inner diameter of substantially 4.2 mm. Such considerations are generally well understood by those having ordinary skill in the art.

The light tube 5 has a circular cross-sectional focused discharge path 14. To ensure desirable operation of the lamp, the discharge path should have a substantially consistent cross-sectional area. Consistent cross-sectional area will ensure that the light intensity remains substantially uniform throughout the entire discharge path. Decrease in diameter or restrictions from a nominal cross-sectional area would result in increased light intensity in the area of restriction and vice-versa. Also, restrictions from nominal increase the local resistance and cause thermal variations which deleteriously stresses the lamp. The preferred cross-sectional area for the discharge path is circular since, among other reasons, light focusing is most readily accomplished from such a light-source shape. Typically, to provide the amount of light and surface area coverage desired, the discharge path 14 will be formed in the light assembly 7 to have a serpentine shape as generally illustrated.

The discharge path 14 is formed between two glass layers generally designated as inner and outer posterior glass layers 26 and 16, respectively. The inner posterior glass layer 26 has two wings 18 extending from a semicircular portion 20 which forms an upper portion of the discharge path 14. The inner posterior glass layer 26 also has a lower flat 22 and an upper flat 24. The outer posterior glass layer 16 has a pair of complementary wings 30 extending from a semicircular portion 28 having an opposite curvature sense with respect to the semicircular portion 20 of outer posterior glass layer 16. The outer posterior glass layer 16 also has a lower flat 40 complementary to the lower flat 22 of the inner posterior glass layer 26 and an upper flat 42 complementary to the upper flat 24 of inner posterior glass layer 26. The inner posterior glass layer 26 nests with the outer posterior glass layer 16 such that respective upper and lower flats and respective wings are in substantially full contact and the respective semicircular portions 20 and 28 form the substantially circular cross-sectional discharge volume or discharge path 14.

In accordance with the exemplary embodiment, each layer of glass is substantially 0.5 mm thick for a total thickness of the co-joined wings of substantially 1.0 mm. Each of the wings is preferably formed with a semi-parabolic curvature and provides a reflector wall for the assembly. In the embodiment illustrated in FIG. 3, a second surface reflective coating 33 is applied to the outer surface of the outer layer 30. Preferred surface coatings include a dichroic metalization layer or silver plate. In the figure, the coating 33 is shown applied to the entire outer surface of the outer layer in addition to the semi-parabolic portions. Masking may alternatively be used to limit deposition of the reflective coating to predefined areas corresponding predominantly to the semi-parabolic wings.

Alternatively, reflective properties may be established by coating the exposed surface of the inner posterior glass layer 26 by selectively coating with a phosphor coating 31. Phosphor coating 31 is shown deposited upon only the exposed surfaces corresponding to the semi-parabolic wings 18 thus allowing the light produced within the discharge path 14 to pass through the semicircular portion 20 and be selectively reflected by the coated surfaces. Additionally, a phosphor coating 34 may be applied to the concave surface of the semicircular portion 28 of the outer layer 30 to enhance the light and improve the output thereof in the desired direction.

Figure 2:
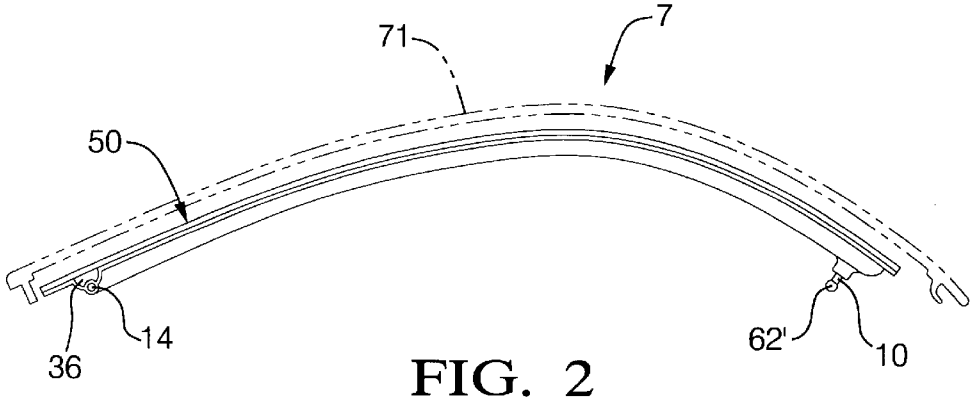
FIG. 2 is a view taken along line 2—2 of FIG. 1.

A light-transmissive cover or layer is generally designated by the reference numeral 50 in the figures and comprises a layer of glass which in the present embodiment is substantially 1.0 mm thick. The light-transmissive cover 50 provides an anterior glass layer for the lamp assembly. The light-transmissive cover 50 is sealably coupled to the upper flat 24 of inner posterior glass layer 26 whereby the envelope defined substantially between pairs of wings 18 on opposite sides of the discharge path and the light-transmissive cover 50 provides a reservoir volume or gas reservoir generally designated by the numeral 36. The light-transmissive cover 50 may be characterized by any of a variety of desired features including tints and optical lensing. In the present embodiment, however, tinting and masking are provided by a plastic light housing 71. The exemplary curvature of the light assembly 7 is illustrated in the view of FIG. 2 and, as can be seen, such light assemblies may be readily adapted for wrap around applications.

Each of the inner and outer posterior glass layers described are preferably co-joined during a hot forming process in accord with well known techniques. The flats 24 of inner posterior glass layer 26 are preferably co-joined with the light-transmissive cover 50 by laying a small bead of frit material between adjacent reservoir volumes 36 at the flats 24 and around the outer periphery of the light assembly 7. The light-transmissive cover 50 is then aligned on top of the inner posterior glass layer 26. The inner posterior glass layer 26 and the light-transmissive cover 50 are then placed in a kiln or lehr and then slowly brought up to a temperature required for fusing the material. The light assembly 7 is then brought back to room temperature and a hermetic seal has been achieved.

Another method of co-joining is to press together the inner posterior glass layer 26 and the light-transmissive cover 50 while they are still in their molten state during from the formation process to thereby fuse the material and create a hermetic seal. However, when such a technique is utilized, coating the exposed surface of the inner posterior glass layer 26 with phosphor is not feasible. Therefore, if the inner posterior glass layer 26 and light-transmissive cover 50 are co-joined by hot processing, a reflective surface is established on the outer surface of the outer posterior glass layer 16 as previously described.

The semicircular portion 20 of inner posterior glass layer 26 has at least one aperture 38 therethrough to provide for fluid communication between the gas reservoir volume 36 and the discharge path 14. In the present preferred embodiment, a single aperture is provided located proximate to one of the electrodes. The aperture is preferably provided by way of laser ablation which provides excellent tolerance control and minimal glass stress in the area of the aperture. By allowing the reservoir volume 36 to communicate with the discharge path 14, the effective volume, which determines the life of the light assembly 7, is increased proportionally. However, the advantages provided by having a constrained focused light source are still available since only the gas within the discharge path 14 is excited by the current.

Figure 5:
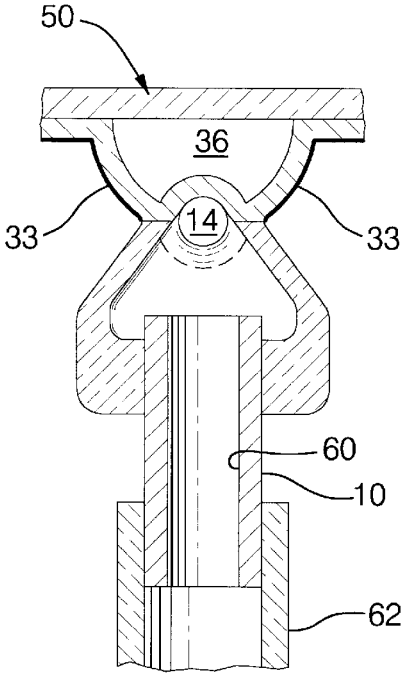
FIG. 5 is a view taken along line 5—5 of FIG. 4.
Figure 6:
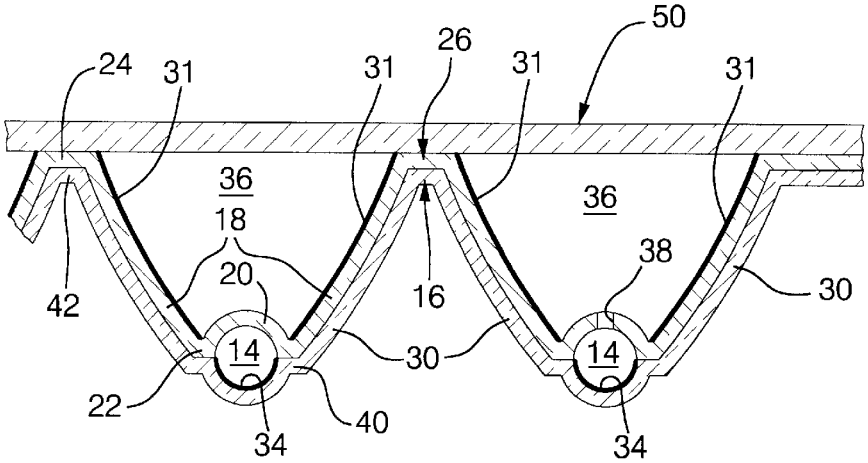
FIG. 6 is a view similar to that of FIG. 3 showing an alternative reflective coating placement.

Any of a variety of well known gas fill techniques may be utilized. For example, a direct fill may be accomplished using an extension of the discharge path through which the discharge gas is communicated and whereafter the extension is pinched off to form a seal. Alternatively, another technique known to those skilled in the art delivers the discharge gas through a bore 60 in the electrode as illustrated in FIG. 5. In such a fill process, the electrodes 10 are fused to a glass fill tube 62 by first heating the respective electrodes and glass fill tube simultaneously to a point sufficient for fusion. After the fill is complete, the electrode is sealed. In either fill technique or other equivalent fill technique, neon or other low pressure gasses, such as argon, helium or a mixture is delivered to the discharge path and ultimately through the aperture into the reservoir. The fill process may be accomplished by evacuating the assembly to approximately 4–5 mm/Hg. Then, a high current is run through the discharge path to heat up the electrodes 10 and the inclusive gas to remove any impurities or undesired gas. The assembly is then evacuated to approximately $10^{-3}$ mm/Hg to remove the impurities. The assembly is then backfilled with the desired gas—neon in the present embodiment—to approximately 20 mm/Hg. The fill path is then hermetically sealed by any well known technique, including pinch-off of the fill tube 62 to form a glass seal 62'.

Figure 3:
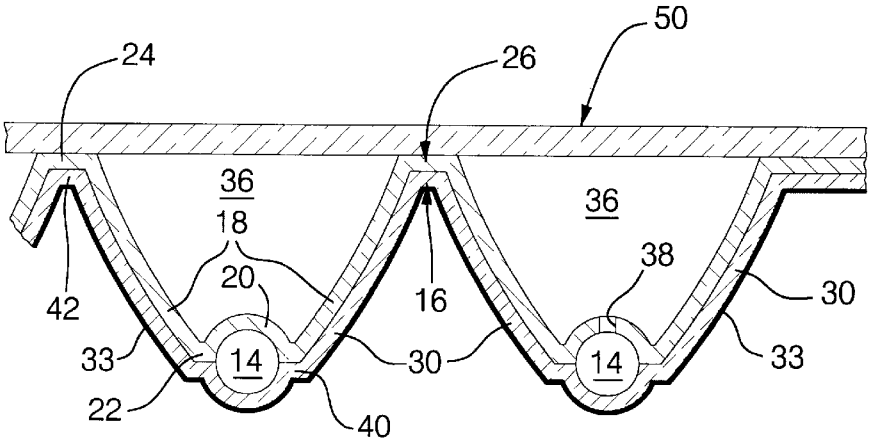
FIG. 3 is an enlarged view of a portion of the automotive signal lamp shown in FIG. 1 taken along line 3—3.
Figure 4:
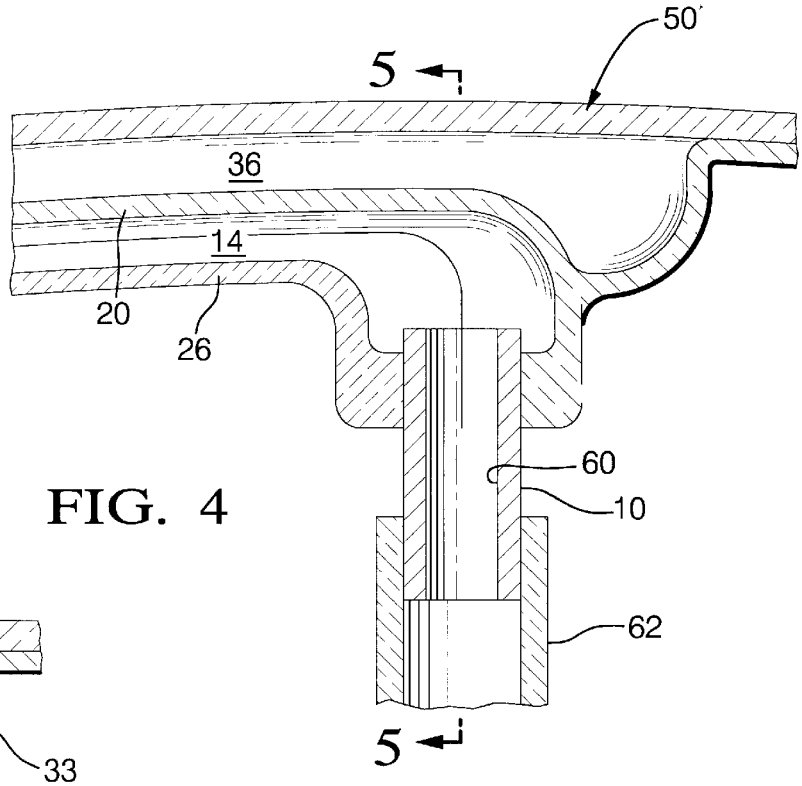
FIG. 4 is an enlarged view of a portion of the automotive signal lamp shown in FIG. 1 taken along line 4—4.

In operation, the arc of the discharge path 14 will generally be centered around the center of the discharge path 14. Light emanating rearwardly (or downwardly as shown in FIG. 3) from the center will impinge upon semicircular section 20 and will then either reflect directly outwardly or indirectly into the wings 30. Light emanating through the semicircular portion 20 of the inner posterior glass layer 26 either passes directly through the light-transmissive cover 50 or is reflected by the reflective coating in the semi-parabolic wings for final transmission through the light-transmissive cover 50. In addition, with the preferred embodiment wherein the reflective coating is a second surface coating on the outer surface of the outer posterior glass layer 16, some light will travel within the glass layers and provide some illumination through the portions of light-transmissive cover 50 directly above the flat areas 24 and 42 of the inner and outer layers, respectively.

While this invention has been described in terms of certain preferred embodiments thereof, it will be appreciated that other forms could readily be adapted by one skilled in the art. Accordingly, the scope of this invention is to be considered limited only by the following claims.

I claim:

1. An hermetically sealed gas discharge lamp assembly comprising:

a discharge volume defined by an elongated tube having a substantially uniform cross-sectional included area;

a pair of reflector walls adjoining said tube at respective proximal ends and emanating away from said tube to respective distal ends remote from said tube;

a light-transmissive cover spanning the respective distal ends of said pair of walls;

a reservoir volume included by said tube, walls and cover;

a portion of said tube intermediate said discharge volume and said reservoir volume providing at least one orifice therethrough; and first and second spaced apart electrodes, each substantially located at respective ends of said tube with a portion disposed within said discharge volume and a portion disposed outside of said discharge volume and said reservoir volume, said electrodes being adapted for connection to a voltage source external the lamp assembly.

2. An hermetically sealed gas discharge lamp assembly as claimed in claim 1 wherein each one of said pair of reflector walls is substantially semi-parabolic.

3. An hermetically sealed gas discharge lamp assembly as claimed in claim 2 wherein each one of said pair of reflector walls is characterized by an outer surface and an inner surface intermediate the outer surface and the reservoir volume, said inner surface having a reflective coating thereon.

4. An hermetically sealed gas discharge lamp assembly as claimed in claim 3 wherein said reflective coating comprises a dichroic metalization layer.

5. An hermetically sealed gas discharge lamp assembly as claimed in claim 2 wherein each one of said pair of reflector walls is light-transmissive and characterized by an outer surface and an inner surface intermediate the outer surface and the reservoir volume, said outer surface having a reflective coating thereon.

6. An hermetically sealed gas discharge lamp assembly as claimed in claim 5 wherein said reflective coating comprises a phosphor coating.

7. An hermetically sealed gas discharge lamp assembly as claimed in claim 1 wherein said substantially uniform cross-sectional included area is substantially circular.

8. An hermetically sealed gas discharge lamp assembly as claimed in claim 1 wherein the elongated tube and the pair of reflector walls adjoining said tube generally follow a serpentine pattern having a plurality of straight runs and at least one end return for joining adjacent ones of said plurality of straight runs.

9. An hermetically sealed gas discharge lamp assembly comprising:

a light-transmissive anterior glass layer;

light transmissive inner and outer posterior glass layers formed having respective pairs of substantially symmetrical spaced walls, each respective pair of walls generally converging from relatively widely spaced distal ends to relatively narrowly spaced proximal ends, said relatively narrowly spaced proximal ends of each respective pair of walls joined by respective intermediate regions spanning said relatively narrowly spaced proximal ends, said relatively widely spaced distal ends of said inner posterior glass layer hermetically joined to said anterior glass layer thereby providing a reservoir volume between said anterior and inner posterior glass layers, the posterior glass layers being formed such that the inner posterior glass layer nests within the outer posterior glass layer with the respective pairs of substantially symmetrical spaced walls being immediately adjacent each other and the respective intermediate regions being in spaced adjacency to provide a discharge volume between the respective intermediate regions;

said intermediate region of said inner posterior glass layer providing at least one orifice therethrough; and first and second spaced apart electrodes penetrating said intermediate region of said outer posterior glass layer with a portion of the electrode disposed within said discharge volume, each electrode substantially located at extreme ends of said discharge volume, said electrodes being adapted for connection to a voltage source external the lamp assembly.

10. An hermetically sealed gas discharge lamp assembly as claimed in claim 9 wherein each wall is substantially semi-parabolic.

11. An hermetically sealed gas discharge lamp assembly as claimed in claim 10 wherein each one of said pair of substantially symmetrical spaced walls of said inner posterior glass layer has an outer surface and an inner surface intermediate the outer surface thereof and the reservoir volume, said inner surface of each one of said pair of substantially symmetrical spaced walls having a reflective coating thereon.

12. An hermetically sealed gas discharge lamp assembly as claimed in claim 11 wherein said intermediate region of said outer posterior glass layer has an outer surface and an inner surface intermediate the outer surface thereof and the discharge volume, said inner surface of the intermediate region having a reflective coating thereon.

13. An hermetically sealed gas discharge lamp assembly as claimed in claim 12 wherein said reflective coating comprises a dichroic metalization layer.

14. An hermetically sealed gas discharge lamp assembly as claimed in claim 11 wherein said reflective coating comprises a dichroic metalization layer.

15. An hermetically sealed gas discharge lamp assembly as claimed in claim 10 wherein said outer posterior glass layer is characterized by an outer surface and an inner surface intermediate the outer surface and the inner posterior glass layer, said outer surface having a reflective coating thereon.

16. An hermetically sealed gas discharge lamp assembly as claimed in claim 15 wherein said reflective coating comprises a phosphor coating.

17. An hermetically sealed gas discharge lamp assembly as claimed in claim 9 wherein each respective intermediate region is semicircular and said provided discharge volume is substantailly circular in cross-section.

18. An hermetically sealed gas discharge lamp assembly as claimed in claim 9 wherein the posterior glass layers generally follow a serpentine pattern having a plurality of straight runs and at least one end return for joining adjacent ones of said plurality of straight runs.

19. A discharge lamp assembly comprising:

two spaced apart electrodes;

an elongated focused path having one of the electrodes approximately at each respective end, the focused path providing a current path;

a pair of semi-parabolic reflector surfaces forming a reservoir therebetween, the reflector surfaces having first and second ends, the first ends being joined to the focused path and the second ends emanating outwardly therefrom, the reservoir fluidly communicating with the focused path through at least one orifice penetrating the focused path; and a light transmitting cover connecting with the seconds ends of the reflector surface providing a boundary for the reservoir.

20. A discharge signal lamp assembly as described in claim 19 wherein the focused path and the reservoir take a serpentine shape.

21. A discharge signal lamp assembly as described in claim 19 wherein the focused path is cross-sectionally circular.

22. A discharge signal lamp assembly as described in claim 19 wherein the first and second reflector surfaces are integrally joined.

23. A discharge signal lamp assembly as described in claim 19 formed primarily from three sheets of material, a first sheet providing a cover, a second sheet forming the first and second reflector surfaces and a portion of the focused path, and a third sheet adjacent the second sheet forming the remainder of the focused path.

* * * * *